United States Patent [19]

Klose

[11] 4,258,827

[45] Mar. 31, 1981

[54] MULTI-PURPOSE PIECE OF FURNITURE FOR USE AS CHAIR AND STEP-LADDER

[75] Inventor: Odo Klose, Wuppertal, Fed. Rep. of Germany

[73] Assignee: Bremshey AG, Solingen, Fed. Rep. of Germany

[21] Appl. No.: 34,148

[22] Filed: Apr. 27, 1979

[30] Foreign Application Priority Data

Jul. 22, 1978 [DE] Fed. Rep. of Germany ..... 2832280
Jul. 22, 1978 [DE] Fed. Rep. of Germany ..... 2832370
Jul. 24, 1978 [DE] Fed. Rep. of Germany ..... 2832423

[51] Int. Cl.[3] ..... A47C 13/00

[52] U.S. Cl. ..... 182/33.3; 297/124; 297/130

[58] Field of Search ..... 182/33, 33.2, 33.4, 182/33.5, 33.6, 33.7; 297/124, 130

[56] References Cited

U.S. PATENT DOCUMENTS

| | | | |
|---|---|---|---|
| 183,924 | 10/1876 | Harrison | 182/33 |
| 1,630,747 | 5/1927 | Johnson | 182/33 |
| 2,607,926 | 8/1952 | De Puy | 182/33 |
| 2,991,828 | 7/1961 | Harrison | 182/33 |
| 3,224,530 | 12/1965 | King | 182/33 |
| 3,811,533 | 5/1974 | Cocker | 182/33 |

FOREIGN PATENT DOCUMENTS

| | | | |
|---|---|---|---|
| 1014759 | 6/1952 | France | 182/33.3 |

*Primary Examiner*—Reinaldo P. Machado

[57] ABSTRACT

An improved multi-purpose piece of furniture which is usable as a chair and as a step-ladder. The arrangement has a base frame and a backrest which is pivotally mounted on the base frame and adapted to be folded from a backrest position to a step-ladder position and vice versa for respective use as the top rung of the step-ladder when it is in a horizontal position and as the backrest of a chair when it is in the backrest position. The arrangement includes a pair of connected frame members forming the base frame. A plurality of rungs are operatively mounted on one of the frame members. The top rung of these rungs is adapted to alternately and selectively form a backrest or a step-ladder rung. An imaginary vertical plane passing through bottom rear edge of the backrest, when it is in the step ladder position is disposed in front and spaced from the front edge of the bottom rung which is connected on the one frame member.

13 Claims, 8 Drawing Figures

Fig. 1
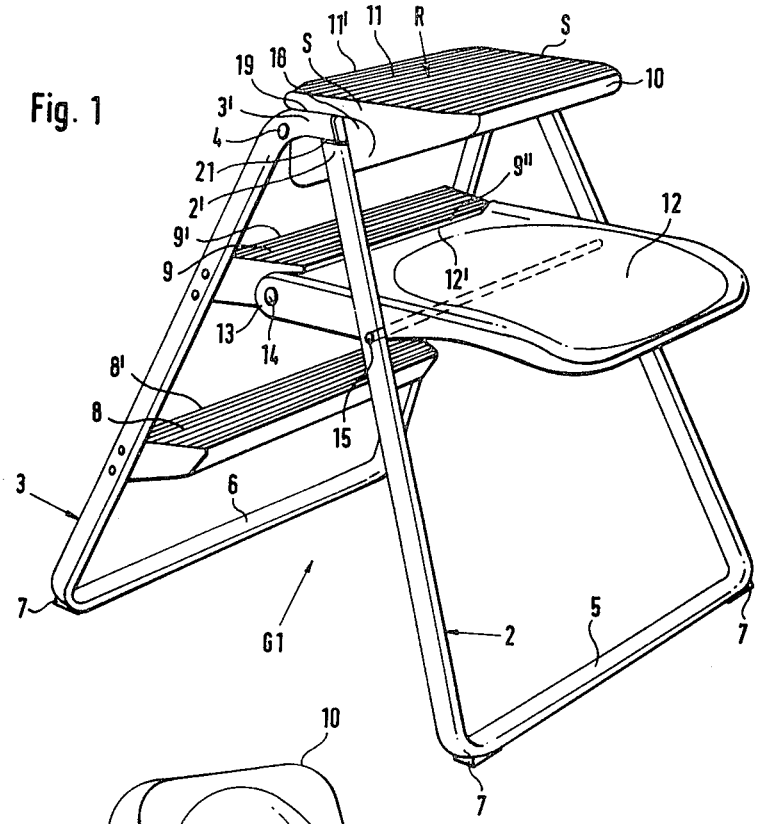
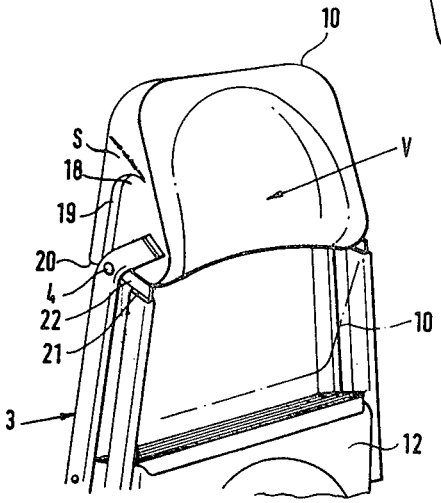
Fig. 2

MULTI-PURPOSE PIECE OF FURNITURE FOR USE AS CHAIR AND STEP-LADDER

BACKGROUND OF THE INVENTION

The invention concerns a multi-purpose piece of furniture usable as a chair and step-ladder, with a base-frame and a backrest, which latter can be folded back to the horizontal position for use as the top rung of the step-ladder.

A piece of furniture of this type is known, for example, from German published patent application No. 2221 483. In this piece of furniture, a panel is arranged, articulated in the area of the upper edge of the backrest, which can be swung out from its basic position serving as a seat into a horizontal position above the seat and in this position it can be used as the top rung of the step-ladder or as a platform to stand on. The seat located under the folded backrest will then form a rung for a step-ladder. This is a disadvantage insofar as the customary spacing of rungs in step-ladders is missing here. It is also disadvantageous that the seat must also be used as a step. The same disadvantage exists with regard to the top rung of the step-ladder insofar as it is also to be formed as a backrest, while in the position as a step-ladder, its backrest front area forms the base of the top rung of the step-ladder. Since one will alternatively step with the foot on the front area of the backrest and then again rest against it with one's back, this multi-purpose of furniture is not practical. The front area of the backrest will not only become worn quickly due to the load it carries when serving as a step, but will also get dirty. But even the possibility available in the piece of furniture disclosed in German patent application No. 2 221 483, according to which the seat is not necessarily used as a step, in that a separate, foldable seat is provided, which will release the actual stepping surface, will not provide a satisfactory solution for the practical use of such a piece of multi-purpose furniture, while also causing unnecessarily high manufacturing costs.

SUMMARY OF THE INVENTION

In contrast, it is an object of this invention to provide with the simplest means and to a certain extent a psychological pressure in the form of separate areas of the piece of furniture for use as seat and ladder, and to design it in such a manner that one will not step on those surfaces of the backrest that are intended as rest-surface, so that such a area could readily be provided with even a delicate padding.

According to the invention, this problem is solved in that the rungs of the step-ladder have a first step situated under the seat and behind the plane surface passing through the rear edge of the seat, and that the top step of the ladder is formed by the back area of the backrest. In this manner an appropriate multi-purpose piece of furniture of increased value has been created, in that the piece of furniture has two optically separate, jointed use areas, without additional expense. On one side there is disposed the chair use area and on the other side there is disposed the step-ladder use area at the back of the chair, with the step-ladder rungs. The user of this piece of furniture is bound from the outset not to step up from the front, on the seat. After folding back the backrest into the horizontal position, the back of the backrest becomes the top rung of the step-ladder. In this position, at least the steps will be situated one above the other in accordance with the usual spacing of rungs of step-ladders. When the backrest is folded back into the basic position for use with the seat, the external appearance of the step-ladder is immediately changed back into that of a seating accommodation. Upon folding the backrest back, a change of surfaces takes place, removing the psychological block against sitting down on or resting against a surface on which one has also stood with one's feet and/or is supposed to stand on. The structural means for changing this circumstance are simple and functional.

According to an advantageous construction of the invention, the seat can be arranged pivoted on a rung arranged at the rear legs of the frame at seat height, and supported by a support on the front legs of the frame. The appropriate pivoting of the seat promotes not only the goal set forth at the outset of a separate jointing of the use area—chair and step-ladder—but also makes possible a space-saving folding of this piece of multi-purpose furniture.

According to a further advantageous construction of the invention, it is an advantage in that the folding frame consists of two U-shaped frames, jointed together by means of one or two joints, and that the backrest forming the top rung of the ladder is jointed to the same joint or joints. In this manner, an additional articulation is saved.

In certain cases, it could also be of advantage to another characteristic of the invention, in that the joint and/or joints of the backrest could be arranged as separate articulation above the joint and/or joints of the folding frame. This solution is of advantage, for example, when a more even rise in the step-ladder position is desired, while retaining the base-size of the multi-purpose piece of furniture.

According to a further characteristic pursuant to the invention, an advantageous arrangement of the backrest can be attained, if the side-walls of the backrest form end stops with niche-like recesses which define the use-positions of the backrest at the folding frame, in either the seat-position or the step-ladder position.

Regarding the backrest, which is jointed in the area of its upper backrest-edge, a favorable, space-saving collapsibility is attained pursuant to a further characteristic according to the invention, in that the end stop supporting the top step is disconnectable for the purpose of letting down the backrest between the U-frames of the folding frame. This could be a sliding lock bolt.

According to a further construction of the invention it is favorable that the backrest has a somewhat triangular cross-section. The triangular shape of the backrest makes possible, above all, a large carrying capacity upon stepping on it and the shaping of a synclinical backrest, favoring a comfortable seat-position. The rear surface forming the top step can nonetheless be completely flat, despite the synclinical shape.

With respect to the stops, an advantageous construction can also be realized, when the rear U-frame of the folding frame has end-sections with bends, in the vertex of which the joint or joints of the folding frame are arranged.

In this respect, it is an advantage according to a further characteristic pursuant to the invention that the front U-frame will form stops with the front ends in the straddle position of the V-shaped folding frame, which stops are below the free end sections of the rear U-frame, and a joint plate of the front U-frame leading to the joint or joints is arranged away from sight directly in one of the end sections or is submerged in a gap between them and the side-walls of the backrest. Pursuant to another advantageous characteristic, the backrest may have a concave shape at its rear area and the ladder-step at the top, and its rest-side and front area.

Another advantageous characteristic consists in that the frame is rigid, has two frame-shaped side-parts which form the respective armrests with their upper frame piece, with a seat arranged between them, the backrest of which stops at the frame against stops on the frame, alternately with its rear-side and the ladder-step, with a short lever-arm (step position) and with a long lever-arm (rest position). When the item is then used as a stepladder, the end area at the joint side cannot be tilted in the sense of a folding down move of the backrest, which imparts a high degree of use-safety to the piece of furniture.

Lastly, an additional advantageous construction according to the invention is obtained in that the seat consists of two folding parts, the rear part of which is jointed to the rear legs of the base and is supported on its front legs, while in the step-ladder position the front part is folded down unto the rear part and forms a step with its bottom surface.

BRIEF DESCRIPTION OF THE DRAWING

Further advantages and details of the subject of the invention are set forth below by means of several exemplified embodiments. Thus:

FIG. 1 is a view in perspective of the multi-purpose piece of furniture pursuant to the invention, usable as chair and step-ladder, in its use-position as a step-ladder;

FIG. 2 is a view in perspective of a cutaway portion of this multi-purpose piece of furniture, folded in a space-saving manner;

DETAILED DESCRIPTION

The multi-purpose piece of furniture illustrates in FIGS. 1 through 5, usable as a chair and as a step-ladder, has a base generally designated G 1. The latter may be V-shaped and collapsible and may have two jointed U-frames 2 and 3 connected at their end segments 2' and 3'. These U-frames may be of round, oval or angular tubing, and can be connected swingably by means of a pivot pin 4. The folding frame G 1 can also be formed by two pairs of legs. The legs or frames 2, 3 can be equipped with slideproof blocks 7.

Figure 3:
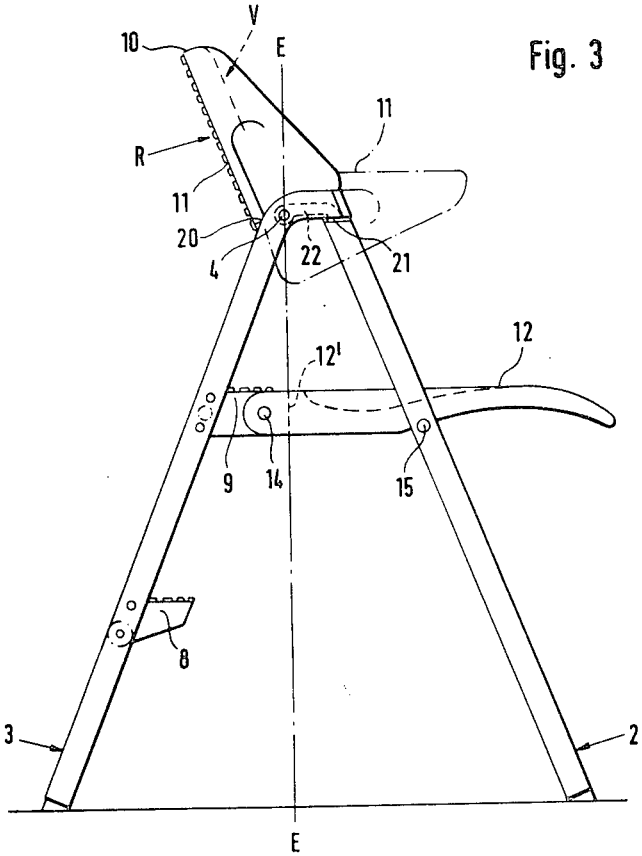
FIG. 3 is a side elevational view of the piece of furniture in its use-position as a chair.

The rear U-frame 3 of the folding frame G 1 is equipped with ladder-rungs 8,9 and an upper platform or rung 11, formed by the rear area of the backrest 10. Of the rungs 8, 9, the front edge of the first lowermost rung 8 is connected to the rear leg 3, near its bottom. The vertical plane E—E passes through the rear edge 12' of the rung 12. (FIG. 3). The center of gravity of the entire arrangement is essentially disposed in plane E—E as illustrated in FIG. 3. The rungs 8, 9 are staggered stepwise in such a manner that the front edges 8' and 9' ending at the outer edge of the rear leg 3, will be in alignment with the front edge 11' of the folded-down backrest 10.

Figure 4:
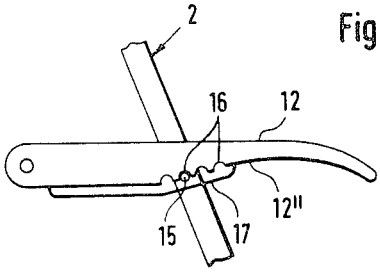
FIG. 4 is a detailed side view of a part of the locking device for the seat.

The rungs 8 and 9 are preferably as wide as the length of a sole of a shoe. The rung 9 can preferably also be used for attaching the seat 12. To this end, the seat 12 can be jointed swingably with its rear edge 12' to the longitudinal edge 9'' of the rung 9, by means of pivot eyelets 13 and a pivot pin 14. In the front, the seat 12 will rest at approximately the same level on a support 15 mounted on the front U-frame 2. The support 15 may consist, for example, of two pegs or of a continuous rod. The bottom side 12'' of the seat 12 may have a series of stop-grooves 16 arranged one after the other for engaging the support 15 in the seat 12, whereby a guide fork 17 may be arranged in the stop-zone, which will prevent the front frame 2 from folding out too much and thus the overturning of the piece of furniture (FIG. 4). Upon raising the seat 12, the projection 15 becomes disengaged from the corresponding stop-groove 16, so that the front U-frame 2, pivoting on the axis 4, can be folded in the direction of the rear U-frame 3. In this manner, the seat 12, through the arrangement of its pivot pin 14 at the ladder-rung 9, will be able to assume the space-saving folded position shown in FIG. 2. Subsequently, the backrest 10 can be moved to the upright position shown in FIG. 2, so that the folded piece of furniture will assume an optimally flat appearance.

Besides this neutral intermediate position, the backrest 10 also takes two stop-limited intermediate positions, namely the use-positions as step-ladder and as chair. In the step-ladder position, the backrest 10 takes the horizontal position, folded down in front, forming the ladder-rung 11 according to FIG. 1, while in the folded up position it serves as backrest of the chair, as shown in FIG. 3. The side-walls S of the backrest 10, which have an approximately triangular shape in section, have niche-like recesses 18 which are shaped in such a manner that they form the end stops 19 and 20 defining the two use-positions. The longer end stop 19 is intended for the use position as a step-ladder, in which the larger load with the body-weight of the person standing on it bears upon the backrest 10.

To permit an even more space-saving arrangement of the overhanging backrest in such a construction, the end stop 19 shown to be rigid in the drawing, can be arranged disconnectably, for the purpose of folding the backrest 10 between the ends 2', 3' of the U-frames 2, 3, for example in the form of a lock bolt that would lock in its end positions and arranged in the relatively voluminous part of the backrest. This additional, space-saving intermediate position of the backrest is shown by a dash-dotted line in FIG. 2.

To be able to brace the folding frame G 1 with as large a surface and as stable a manner as possible, the end sections 3' of the rear U-frame 3 can be angular in the direction of the front U-frame 2, with said end sections 3' projecting forward parallel to the seat 12, starting from the pivot pin 4 seated in the angle vertex of the U-frame 3. In the use position, in which the U-frames take the spread out position shown in FIG. 1, the front ends 21 of the front U-frame 2 rest against the end sections 3' of the rear U-frame 3. A joint plate 22 leads from each of the front ends 21 to the joint. This joint plate can be arranged in a slot in end section 3' or in the gap between this end section and the side wall S. In this exemplified embodiment, the pivot pin 4 of the folding frame can simultaneously form the pivot pin for the foldable backrest 10. The approximately triangular section of the backrest 10 makes it possible to give the ladder-rung 11 a plane surface, on the one hand, and to form the frontal area in a trough-like V-shape, on the other, in order to obtain an as comfortable depth as possible for the seat 12 and an as comfortable as possible lean against the backrest 10. The stepping area 11 situated higher than the seat 12 and extending over approximately half of it can also be used in an advantageous manner as the mounting surface for a child's seat, so that in this fashion a so-called children's chair can be created. By removing this seat, the chair can quickly and easily be changed into its basic form. In this children's chair variant, the seat 12 can serve as support for the child's feet. By lengthening the end sections 3' of the rear U-frame, armrests can easily be formed, which can be arranged in rigid form or attachable by means of a plug-in arrangement.

Figure 5:
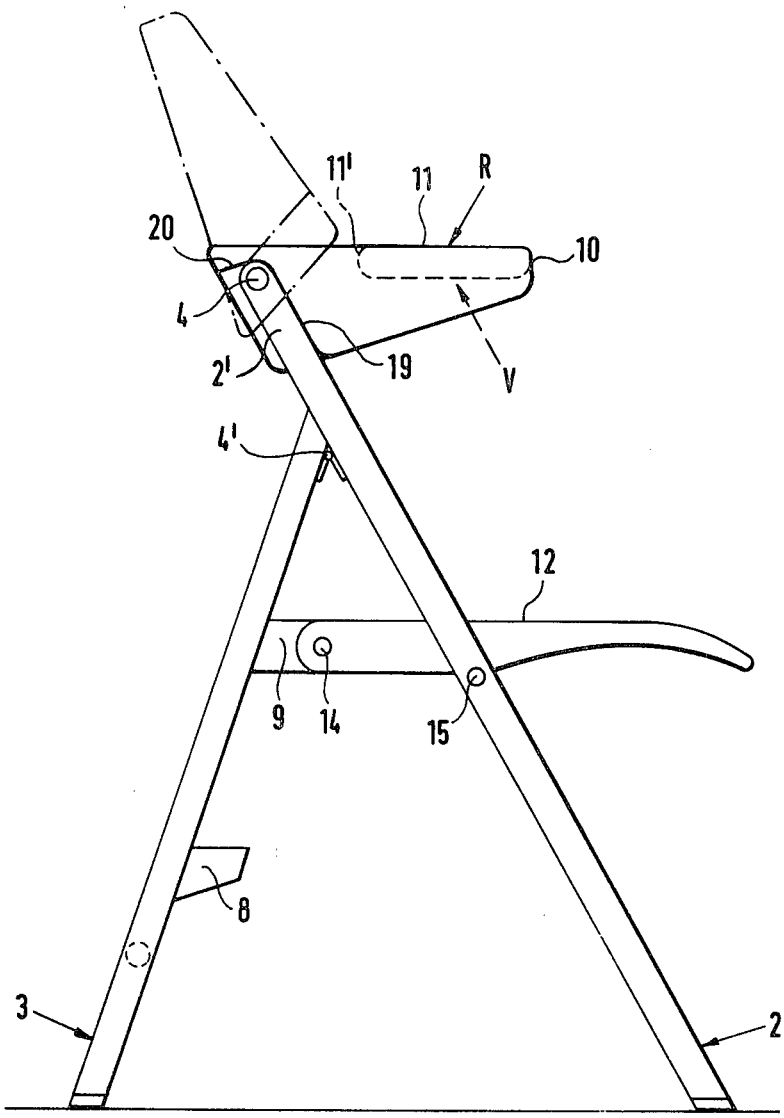
FIG. 5 is a side elevational view of a second embodiment of the multi-purpose piece of furniture.

The exemplified embodiment illustrated in FIG. 5 differs from the above described example only in that the pivot 4 of the backrest 10 is situated above the pivot pin 4' of the folding frame. The end sections 2' of the front legs 2 are lengthened upwards beyond this pivot pin 4'. The front ends of the rear legs 3 defining the spread position rest in a locking manner against the upwardly extended end sections 2' of the front legs 2. The reference numbers have been repeated in an analogous manner with a prime('), to the extent that this is necessary for understanding the illustration. In addition, the lower edge 11' of the backrest is cut back in this embodiment, so that the rungs 8 and 9 and the top step of the ladder 11 will be aligned, as usual.

Figure 6:
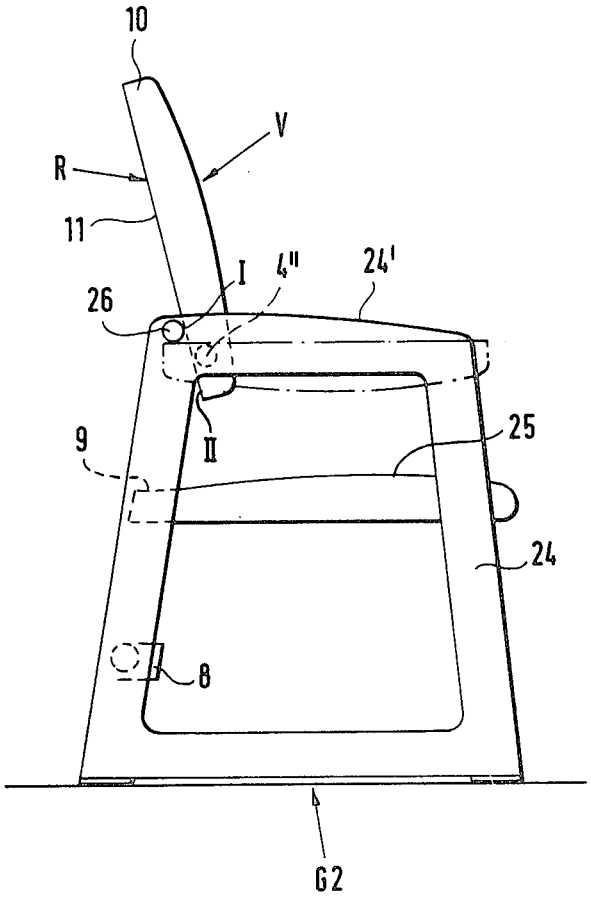
FIG. 6 is a side-elevational view of a further embodiment of the invention.

The base frame need not be arranged foldably only, but can also be rigid, according to the example shown in FIG. 6. According to it, the multi-purpose piece of furniture usable as chair and step-ladder may consist of two frame-shaped side parts 24 which hold a seat 25 firmly arranged on the frame G 2. The upper frame pieces 24' of the side parts 24 form armrests and in their rear areas they have a pivot 4'' for the folding backrest 10. The pivot 4'' may consists of two pins or of one continuous rod. The backrest 10 can be folded in such a manner that with its rear side R and ladder-step 11 it will rest against a stop 26 affixed to the frame alternately with its short lever arm II and with its long lever arm I, at both sides of the pivot 4''. In the rest position shown in a solid line, the long lever arm I adjoins the stop 26, and in the dash-and-dot ladder position the short lever arm II adjoins the stop 26. All step-surfaces can be provided with a nonskid surfacing.

Figure 7:
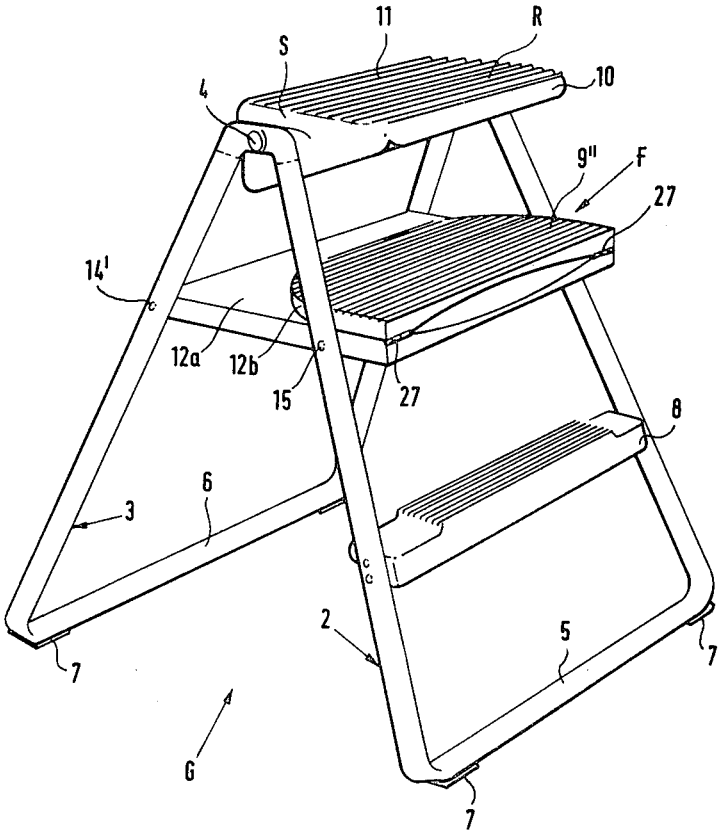
FIG. 7 is a view in perspective of a further embodiment of the multi-purpose piece of furniture according to the invention, shown as a step-ladder.
Figure 8:
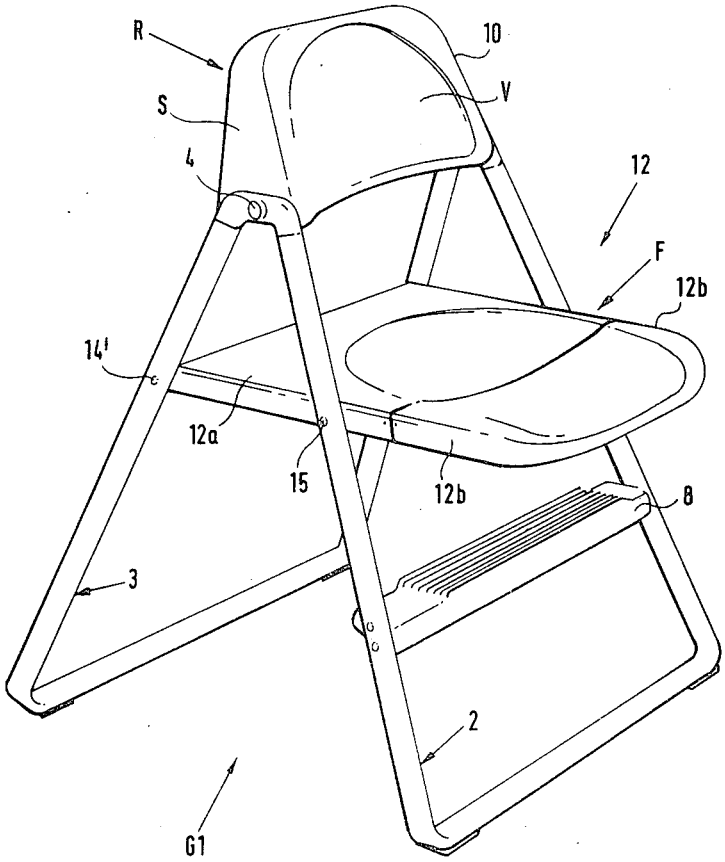
FIG. 8 illustrates the embodiment of FIG. 7 in its use-position as a chair.

In the exemplified embodiments shown in FIGS. 7 and 8, the seat 12 consists of two parts **12*a* and 12*b* foldably joined by hinges 27. The rear part 12*a* is pivotally connected to the rear legs 3 by means of a pivot pin 14' or by two such pins, and in the front it can be supported by a support 15 of the front legs. When the front part 12*b* is folded from the seat position shown in FIG. 8 onto the rear part 12*a* and into the use position as a step-ladder as shown in FIG. 7, the bottom side F of the rear part 12*a* forms the center step 9'' between the bottom rung 8 on the front legs 2 and the top platform of step rung 11 on the rear side R of the backrest 10. By raising the seat 12, the piece of furniture can be folded into a space-saving position, with the legs 2 and 3 arranged so that they will fold over axis 4**.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An improved multi-purpose piece of furniture usable as a chair and as a step-ladder, having a base-frame and a backrest pivotally mounted on said base-frame and adapted to be folded from a back-rest position to a horizontal step-ladder position and vice versa for respective use as the top rung of the step-ladder when in the horizontal position and as the back-rest of a chair when in the back-rest position, the improvement comprising a pair of pivotally connected frame members forming said base frame, a plurality of rungs in addition to said top rung operatively mounted in one of said frame members, each rung having a front edge and a rear edge, the uppermost rung of said plurality of rungs being pivotally mounted on one of said members and being adapted to alternately form a back-rest and step-ladder rung and also having a front edge and a rear edge when in the horizontal position, and also having an upper and lower edge when in the back-rest position; and imaginary vertical plane passing through said lower edge of said back-rest, when it is in the horizontal position, lies in front of the front-edge of the lower-most rung.

2. The improved multi-purpose piece of furniture according to claim 1, including an intermediate rung connected to said one frame member, a seat jointed to the rear of said intermediate rung, and support means mounted on the other frame member, said seat is supported by said support means on the said other frame member.

3. The improved multi-purpose piece of furniture, according to claim 1, wherein the base-frame is in the form of a folding frame and the two frame members are in the form of two U-frames connected to each other by at least one joint, and wherein the top rung forms a back-rest which is jointed to the same joint.

4. The improved multi-purpose piece of furniture according to claim 3, wherein said two U-frames are connected to each other by two joints.

5. The improved multi-purpose piece of furniture, according to claim 4, wherein the pivot connection between said back-rest and one frame member has its pivot point disposed above said at least one joint.

6. The improved multi-purpose piece of furniture according to claim 5, wherein the side walls of the backrest are provided with niche-like recesses which form end stops defining the use positions of the backrest at the folding frame in the back-rest and step-ladder positions.

7. The improved multi-purpose piece of furniture according to claim 6, wherein the end stop supporting the backrest in the step-ladder position is adjustable to permit the backrest being folded between the U-frames of the folding frame.

8. The improved multi-purpose piece of furniture according to claim 6, wherein the backrest has an approximately triangular cross-section.

9. The improved multi-purpose piece of furniture according to claim 6, wherein the rear U-frame of the folding frame has end sections with angles, in the vertices of which are arranged the joint or the joints of the folding frame.

10. The improved multi-purpose piece of furniture according to claim 9, wherein the folding frame is V-shaped when unfolded, the front U-frame forms in this spread position stops with the front ends below the free end sections of the rear U-frame, and wherein the front U-frame has a joint plate leading to the joint or joints, respectively, which is arranged out of sight directly in a slot of the end section or dips into a gap between it and the side walls of the backrest.

11. The improved multi-purpose piece of furniture according to claim 1, wherein the backrest has a flat back surface and step-surface, the back surface forming a rest-side a portion of which is concave.

12. The improved multi-purpose piece of furniture according to claim 3, wherein the seat consists of two foldably joined parts and the rear and front frame members having a pair of legs, the rear joined part is jointed to the rear pair of legs of the rear frame member and is supported by the front legs of the front frame member, while the front part is foldable in the step-ladder position on the rear part and forms with its bottom side the step-surface of a rung.

13. An improved multi-purpose piece of furniture usable as a chair and as a step-ladder, having a base frame and a back-rest pivotally mounted on said base frame and adapted to be folded from a back-rest position to a horizontal step-ladder position and vice versa for respective use as the top rung of the step-ladder when in the horizontal position, and as a back-rest of a chair when in the back-rest position, the improvement comprising, said base-frame being rigid and includes two frame-like side parts which form the respective armrests for the chair;

a seat mounted between said side parts which also forms the middle rung when said piece of furniture is used as a step-ladder; and a bottom rung mounted between said side parts, each rung, including the top rung when in the step-ladder position, has a front edge and a rear edge, an imaginary vertical plane passing through the rear edge of said uppermost rung, when in the step-ladder position, lies in front of the front edge of the lowermost bottom rung.

* * * * *